United States Patent [19]

Lindsey et al.

[11] Patent Number: 4,833,832

[45] Date of Patent: May 30, 1989

[54] PRODUCTION OF POLISHED FLAT GLASS

[75] Inventors: Alan F. Lindsey, Braine Le Chateau; Jean-Marie Jacquemin, Auvelais-Sambreville, both of Belgium

[73] Assignee: Patrick Depuydt, Delimont, Switzerland

[21] Appl. No.: 61,435

[22] PCT Filed: Sep. 10, 1986

[86] PCT No.: PCT/GB86/00537

§ 371 Date: May 8, 1987

§ 102(e) Date: May 8, 1987

[87] PCT Pub. No.: WO87/01321

PCT Pub. Date: Mar. 12, 1987

[30] Foreign Application Priority Data

Sep. 10, 1985 [GB] United Kingdom ..... 8522441

[51] Int. Cl.[4] ..... B24B 7/24

[52] U.S. Cl. ..... 51/54; 51/283 R; 51/240 GB; 51/110

[58] Field of Search ..... 51/54, 56, 283 R, 240 GB, 51/235, 110

[56] References Cited

U.S. PATENT DOCUMENTS

| | | | |
|---|---|---|---|
| 1,027,558 | 5/1912 | Meyers | 51/54 |
| 1,233,120 | 7/1917 | Patch | 51/56 |
| 1,815,547 | 7/1931 | Byrnes | 51/235 |
| 2,443,987 | 6/1948 | Morrison et al. | 51/235 |
| 2,985,989 | 5/1961 | Knost | 51/56 |
| 3,006,116 | 10/1961 | Knost | 51/283 |
| 3,026,653 | 3/1962 | De Zordo | 51/56 |

FOREIGN PATENT DOCUMENTS

| | | | |
|---|---|---|---|
| 1938477 | 2/1970 | Fed. Rep. of Germany | 51/56 |
| 0567783 | 3/1924 | France . | |
| 2358967 | 2/1978 | France . | |
| 2480173 | 10/1981 | France . | |
| 2548073 | 3/1985 | France . | |
| 0972693 | 10/1964 | United Kingdom | 51/56 |

*Primary Examiner*—Frederick R. Schmidt
*Assistant Examiner*—Robert A. Rose
*Attorney, Agent, or Firm*—Nixon & Vanderhye

[57] ABSTRACT

A method of polishing a glass sheet which includes the steps of supporting the glass sheet in a substantially horizontal position with one of its major faces uppermost, providing a substantially horizontal gantry (11) supported so that it can be traversed across the exposed upper surface of the glass sheet, providing a plurality of diamond edged grinding wheels (13, 14, 15) supported on the gantry (11) each arranged for rotation about an axis which is substantially parallel to that of the or each other grinding wheel and with the locus of its grinding face arranged to lie substantially in a common plane with the corresponding locus of the or each other grinding wheel, setting the heights of said grinding wheels such that said common plane coincides substantially with or lies marginally below the exposed upper surface of the glass sheet, and moving the gantry (11) relative to the glass sheet so as to cause the grinding wheels to traverse the glass sheet and remove a layer of glass therefrom.

21 Claims, 1 Drawing Sheet

PRODUCTION OF POLISHED FLAT GLASS

This invention relates to glass polishing, more particularly to polishing of sheet glass.

Until the development of the so-called float glass process it was, generally speaking, difficult and time consuming to produce plate glass with an acceptably flat surface. As the human eye is capable of seeing even small depressions or hills with a depth or height of at most a few microns as imperfections in a glass surface, it is in practice necessary to produce sheet glass with extremely flat surfaces for glazing or for other architectural purposes.

The float glass process revolutionised the production of plate glass. However, as the process requires to be operated continuously and as the capital cost of the plant is high, it has had the effect in practice of reducing the available types of glass so that only a small number of different colours and thicknesses of plate glass sheet are currently commercially available. Hence an architect is effectively restricted in his choice of glazing materials to that range of colours which operators of the float glass process have found to be the most generally acceptable in the market.

One of the major advantages of the float glass process is that the "as produced" glass sheets have surfaces which are sufficiently flat for use in the building industry without further treatment. Thus there is no need to subject float glass sheets to polishing steps before they can be used.

When it is desired to impact increased strength and/or fire resistance to sheet glass, metal wire mesh can be embedded in the glass while it is in a semi-fluid state using a rolling technique. However this procedure destroys the surface characteristics of the resulting cast wire glass sheet and it is necessary to flat grind and to polish both faces of the wire glass sheet in order to improve the flatness of its faces and its transparency before it can be accepted for use in the building industry.

Production of wired glass is not directly possible in the float glass process. Thus in practice polished wired glass is produced on the last existing "polished plate glass" lines. Daily production of such polished plate glass units is generally from about 80 tons to about 100 tons per day. Such a polished plate glass line integrates all stages of manufacture from mixing the raw materials, melting, cooling, mechanical flat grinding and polishing of both faces, cutting and packaging.

For manufacture of wired glass sheets additional equipment is incorporated in the corresponding polished plate glass line, including the necessary wire feed arrangement and one or more sets of rolls for embedding the wire mesh in the still hot, semi-fluid glass. The capital cost of such units is high.

Typical methods of polishing of faces of glass sheet adopted heretofore include the use of fibre wheels in conjunction with cerium oxide grinding paste after the faces have been flat ground with sand on iron wheels.

It is also known to polish the edges of glass sheets with diamond edged grinding wheels and to use such wheels also for imparting a bevelled edge to glass sheets. Diamond edged grinding wheels are also used for shaping optical glass, e.g. for production of lenses.

GB-A-No. 1114474 describes a system for the surfacing of flat sheets of glass and other hard materials. As shown in FIG. 1A of GB-A-No. 1114474, such a surfacing system may include use of a plurality of grinding wheels arranged one after another along the path of movement of a glass sheet. As indicated in FIG. 1 each grinding wheel is wider than the sheet of glass 11 to be ground. According to the description at page 3, lines 45 to 51 it is envisaged that the grinding wheels have arcuate segments having a radial dimension of 1.5 inches (38.1 mm), lying between 31 and 29.5 inches (787.4 and 749.3 mm) from the axis of the grinding wheel 10. In other words each wheel is at least 5 feet (1524 mm) in diameter.

In such a system periodic replacement of the grinding wheels is necessary. In view of their size, the cost of replacement wheels is correspondingly high.

Although the surfacing system of GB-A-No. 1114474 may be satisfactory for polishing plate glass, in which any surface imperfections are relatively small, it would seem unsuited for use with wired sheet glass which has relatively large "hills" and "valleys" in its surfaces which are more or less randomly distributed on its surfaces. There is a danger with such a system that, if there is a particularly prominent "hill" offset from the axis of the grinding wheel, there is a considerable risk of juddering due to point contact of the grinding wheel with the "hill" instead of more or less uniform contact between the grinding wheel and the glass sheet over the entire face of the glass sheet. Such juddering can damage the bearings of the grinding wheel and result in burring of the surface of the glass sheet.

The present invention seeks to provide an improved method of producing polished plate glass, such as polished wired glass sheet, which offers greater flexibility of operation than can be achieved with a conventional "polished plate glass" unit dedicated to production of polished glass sheet.

It further seeks to provide apparatus which can be used for polishing glass sheets, e.g cast wired glass sheets, which have been produced at a different location from the apparatus.

According to the present invention there is provided a method of polishing a glass sheet which includes the steps of supporting the glass sheet in a substantially horizontal position with one of its major faces uppermost, providing a substantially horizontal gantry supported so that it can be traversed across the exposed upper surface of the glass sheet, providing a plurality of diamond edged grinding wheels supported on the gantry each arranged for rotation about an axis which is substantially parallel to that of the or each other grinding wheel and with the locus of its grinding face arranged to lie substantially in a common plane with the corresponding locus of the or each other grinding wheel, setting the heights of said grinding wheels such that said common plane coincides substantially with or lies marginally below the exposed upper surface of the glass sheet, and moving the gantry relative to the glass sheet so as to cause the grinding wheels to traverse the glass sheet and remove a layer of glass therefrom. Conveniently the glass sheet is supported on a fixed bed and may be held on the bed by applying a partial vacuum to the under surface thereof.

The invention further provides apparatus for polishing a glass sheet which includes a grinding station comprising support means for supporting a glass sheet in a substantially horizontal position with one of its major faces uppermost, a substantially horizontal gantry supported so that it can be traversed across the exposed upper face of the glass sheet, a plurality of diamond edged grinding wheels supported on the gantry, each arranged for rotation about an axis which is substantially parallel to the axis of rotation of each other grinding wheel and with the locus of its grinding face arranged to lie substantially in a common plane with the corresponding locus of the or each other grinding wheel, said grinding wheels further being set at a height above said support means such that said common plane coincides substantially with or lies marginally below the exposed upper surface of the glass sheet and means for effecting relative movement between the gantry and the glass sheet so as to cause the grinding wheels to traverse the glass sheet and remove a layer of glass therefrom.

In a preferred arrangement said support means comprises a fixed bed. In this case said means for supporting a glass sheet on the bed comprises means for applying a partial vacuum to the undersurface thereof. In a preferred form of the apparatus the bed is provided with a peripheral gasket to assist in sealing.

In a preferred embodiment the gantry spans the bed and is arranged to run on rails extending along opposite sides of the bed. In this case the grinding wheels may be carried on a sub-carrier which is arranged to move relative to the gantry in a direction transverse to the rails. The sub-carrier may be, for example, a trolley.

The diamond faced grinding wheels used in the invention are commercially available. Such wheels are generally cup-shaped with a peripheral band (usually a discontinuous peripheral band) of diamond particles embedded in the metal rim thereof. Conveniently the wheels are mounted on hollow axles down which water can be pumped at an appropriate volume and pressure in order to provide cooling for the wheel and the glass sheet. Gaps in the rim of the wheel permit the water to flow out, carrying with it the debris resulting from grinding. Upon rotating such a wheel in contact with a glass sheet, the locus of its grinding face is a planar ring. Typically the wheels range in diameter from about 12 cm to about 25 cm, e.g. about 20 cm. The rate of rotation of such grinding wheels is preferably such as to impart a rim speed of from about 22 m/sec to about 27 m/sec.

It is a feature of the invention that the locus of the grinding face of each grinding wheel lies substantially in a common plane with the corresponding locus of the or each other grinding wheel. In practice the grinding wheels will usually be set at slightly different heights so that each grinding wheel removes a respective stratum of glass as the grinding wheels are traversed over the exposed upper surface of the glass sheet. Although it is envisaged that the grinding wheels may lie exactly in a common plane, this will usually only be practicable in the case where the exposed upper face of the glass sheet to be polished is already relatively flat and has surface imperfections in the form of hills and valleys such that the difference in level between the highest peak and the deepest valley present is no more than a few micrometers, e.g. 10 micrometers or less. In this case the grinding wheels will be set at a height such that the common plane lies a small distance, e.g. a distance in the range of from 5 to 10 micrometers, below the bottom of the deepest valley present. The necessary vertical adjustment of the grinding wheels for this purpose can be achieved by appropriate adjustment of screws which raise or lower the individual grinding wheel and its associated motor. Whether or not a particular glass sheet can be surfaced with the grinding wheels set so that the loci of their grinding faces lie exactly in a common place will depend upon a number of factors including the hardness of the glass, the diameters of the grinding wheels, the coarseness or fineness of the diamond particles, and their speeds of rotation.

In some cases, however, the difference in level between the highest peak and deepest valley in the exposed upper face of the glass sheet may be up to about 600 micrometers. This difference is relatively insignificant in comparison with the overall thickness of the glass sheet, e.g. about 6.4 mm or more, but such peaks and valleys represent undesirable imperfections in the surface of the glass sheet which are clearly visible to the naked eye. Such peaks and valleys may arise, for example, in the production of wired glass sheet in the course of the rolling operation used to embed the reinforcing wire in the fluid or semi-fluid glass sheet.

When badly imperfect glass sheets are being surfaced it may be necessary to make two passes of the gantry with its grinding wheels over the exposed upper surface, having adjusted the heights of the wheels appropriately between the passes. Normally, however, a single pass of the gantry over the exposed upper face of the glass sheet will suffice to impart acceptable features thereto.

For safety's sake it will usually be desired to set the height of the grinding wheels so that their grinding faces, or the grinding face of the lowermost grinding wheel, lies slightly below, e.g. about 5 to 10 micrometers, the bottom of the deepest valley present. Hence the maximum space between the locus of the grinding face of the uppermost grinding wheel and that of the lowermost grinding wheel will not usually exceed about 750 micrometers. Hence by stating that the respective loci lie "substantially in a common plane" we means that the loci lie either exactly in a common plane or in one or more planes which differ in height by no more than about 750 micrometers.

The grinding wheels may thus each be set with the locus of its grinding face at a different height from that of the other grinding wheels and the wheels may be so traversed over the glass sheet that each grinding wheel removes a respective stratum of glass in passage thereover.

It will usually be expedient to set the height of the grinding face of the lowermost grinding wheel so as to remove a stratum of glass of predetermined thickness lying below the bottom of the deepest valley mapped.

In a preferred method the grinding faces of the grinding wheels are set at respective heights such that each grinding wheel removes a stratum of glass of substantially equal depth.

The upper surface of the bed may be prepared by traversing the grinding wheels across the exposed surface thereof.

The method of the invention may further include the subsequent step of smoothing the surface of the glass sheet with at least one cast iron smoothing wheel in conjunction with a suspension of abrasive particles, as well as the subsequent step of buffing the smoothed surface of the glass sheet with revolving felt pads in conjunction with a suspension of abrasive particles. The bed used in the grinding step may be provided with a peripheral gasket to assist in sealing.

In an alternative preferred form of apparatus said support means comprises a conveyor means arranged to support said glass sheet substantially horizontally and said plurality of grinding wheels are mounted on a gantry with their axes of rotation substantially vertical, said gantry being traversable above the exposed face of the glass sheet so that said grinding wheel grind said exposed face. In this form of apparatus the glass sheet is reversed for grinding of its other face. In this form of apparatus said support means conveniently comprises a substantially horizontal conveyor and said gantry is arranged to traverse from side to side of the glass sheet in a direction transverse to the direction of movement of said conveyor. The conveyor can, in this case, remain stationary if the grinding wheels are arranged, for example, in a staggered array whereby the grinding patterns of the wheels overlap transverse to the direction of movement of the gantry so that grinding can be achieved by traversing the gantry across a stationary glass sheet. Alternatively, if a single line of grinding wheels is supported on the gantry, the glass sheet can be slowly advanced, continuously or intermittently, under the traversing gantry in order to effect polishing of the entire exposed face of the glass sheet.

It will be appreciated by those skilled in the art that, besides the use of diamond edged grinding wheels, the invention proposes the possibility of separating the polishing operation from the other aspects of flat glass manufacture. The separation of the polishing operation from the flat glass production line gives rise to the following advantages:

the speed of production of the polished glass can be controlled at will, whereas other systems are obliged to absorb the entire production of a continuously producing oven.

one can change the material to be polished at will and select its quality before polishing, whereas installations integrated into a production line must deal with all the glass coming out of the furnace whatever its quantity or quality.

one can repolish part of the production if its quality is judged insufficient, whereas this is impossible in an integrated line.

one can choose the glass to be processed from the whole range of glass types currently manufactured without being limited to those products capable of being fabricated in the oven at the beginning of the integrated production line.

one can choose to install a low capacity plant according to the needs of the local market.

In an alternative embodiment (not illustrated), the sheet of glass is supported horizontally on a flat bed conveyor under a grinding station which comprises a horizontal gantry supported so that it can be traversed across the exposed face of the glass sheet in a direction transverse to the direction of movement of the flat bed conveyor and carrying a plurality of diamond edged grinding wheels each arranged for rotation about a substantially vertical axis and with its grinding face lying substantially in a common plane with the corresponding faces of the other grinding wheels. Whilst the glass sheet is held stationary or is advanced slowly continuously or intermittently the gantry is traversed across the glass sheet from side to side until its face has been polished satisfactorily. Then the glass sheet is run on the flat bed conveyor out of the path of the gantry, reversed and put back under the gantry for polishing of the other face thereof.

In order that the invention may be clearly understood and readily carried into effect, a preferred method of polishing sheet glass, and apparatus for carrying out such a method, will now be described, by way of example only, with reference to the accompanying diagrammatic drawings, wherein.

Figure 1:
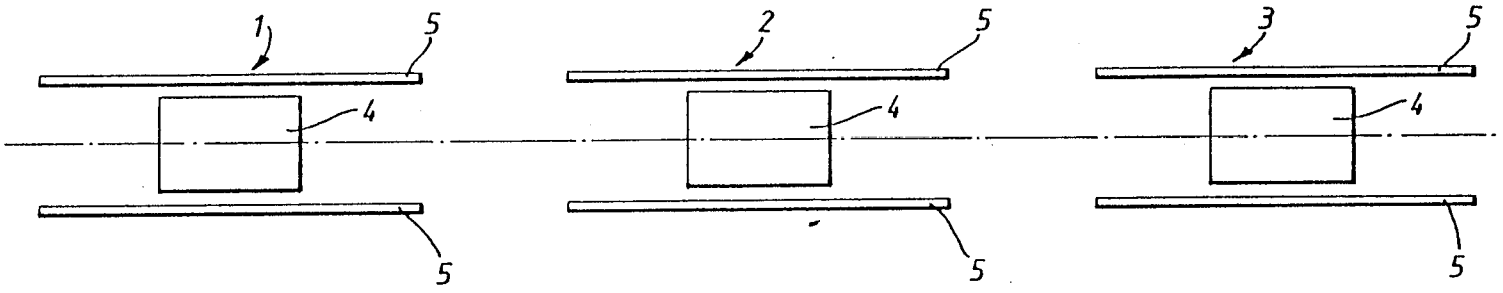
FIGS. 1 and 2 are plan and side views respectively of the fixed parts of the apparatus.
Figure 2:
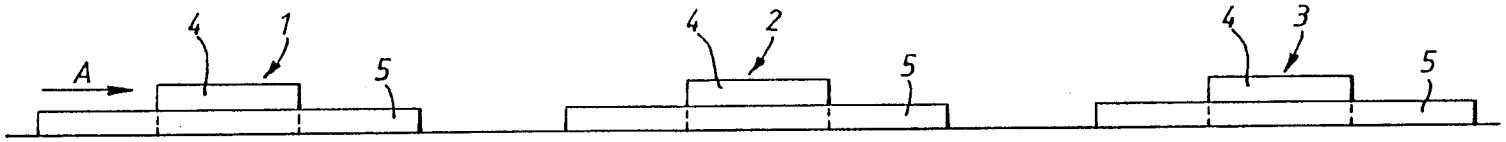

Referring to FIGS. 1 and 2 of the drawings, an apparatus for polishing glass sheets, for example wired glass sheets, includes a grinding station 1, a smoothing station 2, and a buffing station 3. At each station there is a fixed bed 4 in the form of a concrete block, along either side of which are positioned a corresponding pair of rails 5 for a travelling gantry (not shown in FIGS. 1 and 2).

In operation of the apparatus a glass sheet moves in turn from one station to the next as indicated by the arrow A in FIG. 2.

Figure 3:
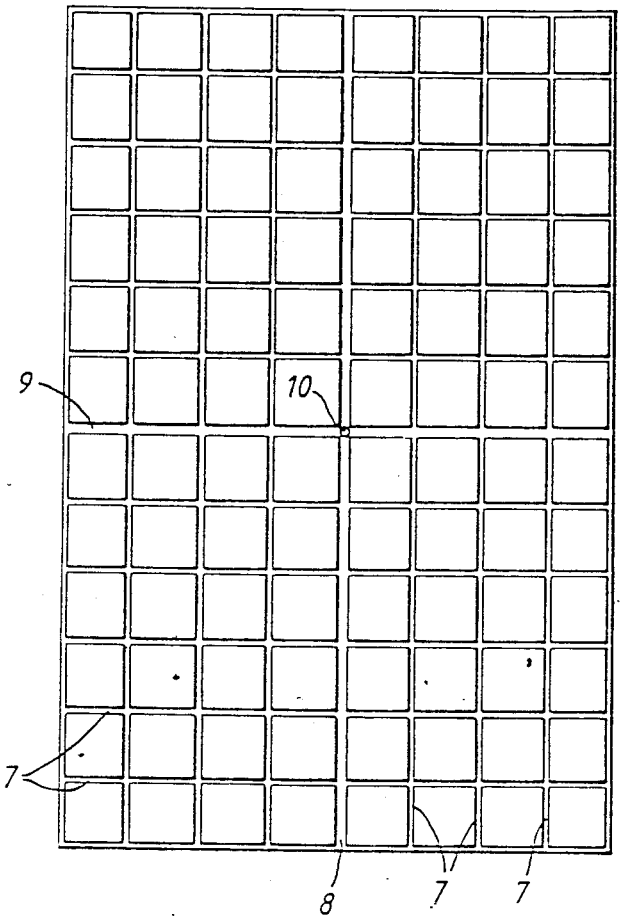
FIG. 3 is a plan view of a bed upon which a sheet of glass to be polished can be supported.
Figure 4:
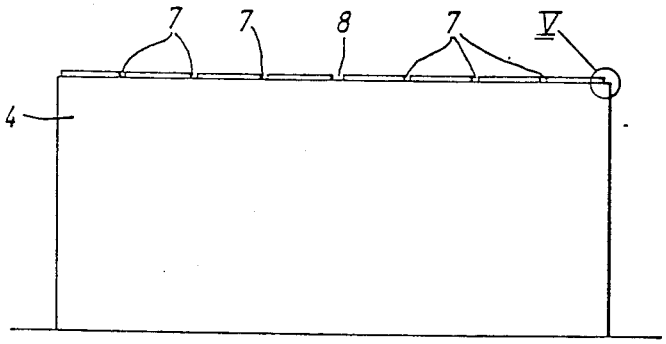
FIG. 4 is a vertical section through the bed of FIG. 3.

As can be seen from FIGS. 3 and 4, each bed 4, which is typically 3 meters long by 2 meters wide, has a number of grooves 7 formed in its upper surface which communicate with broader channels 8 and 9 that intersect at the mid-point of bed 4. At the intersection of channels 8 and 9 there is positioned a vacuum connection to a vacuum pump (not shown). A peripheral gasket 11 runs around the periphery of the bed 4 so that, when a sheet of glass (not shown) which is slightly larger than the bed 4 is placed face down on the bed 4 and a partial vacuum is applied to its underface via a vacuum connection 10, a good seal is obtained all round the bed 4 and the sheet of glass is held firmly on the bed 4.

Figure 6:
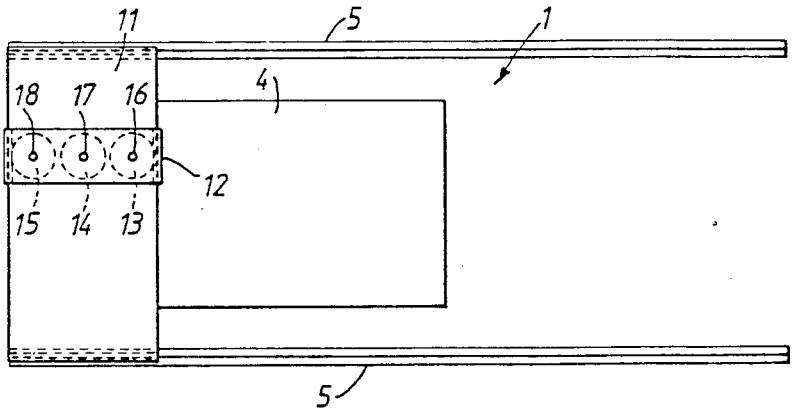
FIGS. 6 and 7 are plan and side views respectively of the grinding station of the apparatus.
Figure 7:
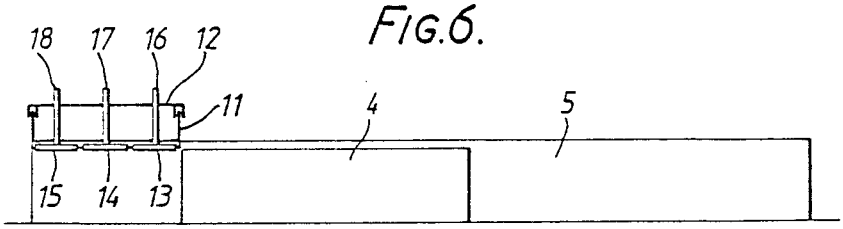

FIGS. 6 and 7 show the grinding station 1 in a little more detail. A gantry 11 which is arranged to run on wheels (not shown) on rails 5 spans bed 4 and can be driven along rails 5 by means of a motor (not shown). Gantry 11 carries a trolley 12 which carries on its underside three diamond edged grinding wheels 13, 14 and 15, each mounted for rotation about a respective shaft 16, 17 and 18 and each arranged to be driven by a respective motor (not shown). Each of grinding wheels 13, 14 and 15, its associated shaft, 16, 17 and 18, and its respective motor is mounted on the trolley 12 by a suitable arrangement enabling the vertical height of the respective grinding wheels, 13, 14 and 15 relative to the upper surface of the bed 4 to be adjusted to close tolerance, i.e. to an accuracy of 10 micrometers of less.

Figure 8:
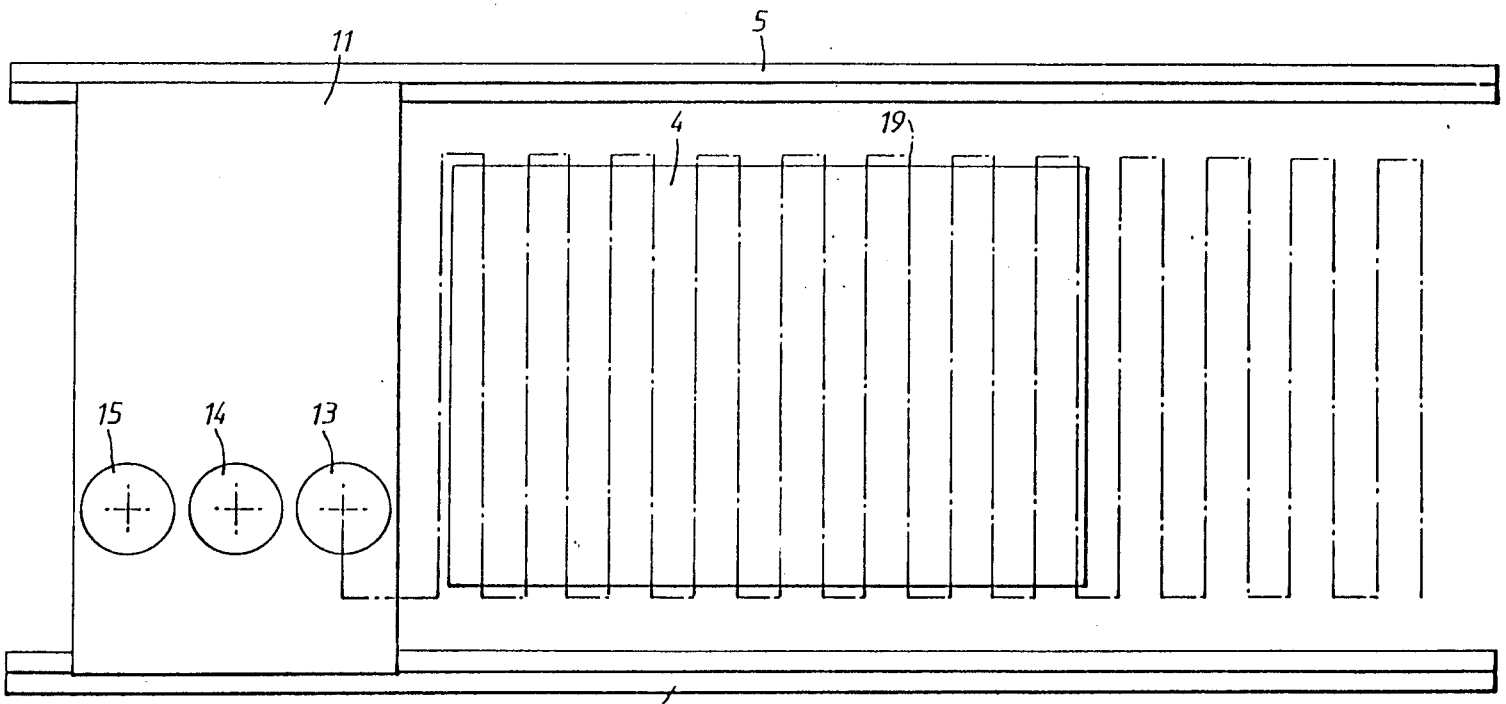
FIG. 8 shows the locus of movement of the axis of one of the grinding wheels during a grinding operation.

FIG. 8 is a simplified view of the apparatus, corresponding to FIG. 6, but with the trolley 12 omitted. Assuming that the grinding wheels 13, 14 and 15 are in the positions indicated, with their height above bed 4 having been preset so as to achieve the desired depth of cut when the respective grinding wheel moves across the surface of the glass sheet, and with the gantry 11 at rest, the trolley 12 is traversed across the gantry 11 (in a direction corresponding to the downward direction as illustrated in FIG. 8) until it reaches the limit of its travel. Next the gantry 11 is advanced towards bed 4 a predetermined distance and then stopped. Next, the gantry 11 is traversed in the opposite direction across the bed 4 until it reaches its other limit of movement. Then the gantry 11 is advanced again a predetermined distance along rails 5 (in the rightward direction, as illustrated in FIG. 8) and the trolley 12 is traversed back across the gantry 11. In this way the locus of the grinding wheel 13 follows the "square wave" path indicated by reference numeral 19 in FIG. 8. Throughout the grinding operation a plentiful supply of water is fed to the grinding wheel 13, 14, 15 by a suitable arrangement (not shown).

Figure 9:
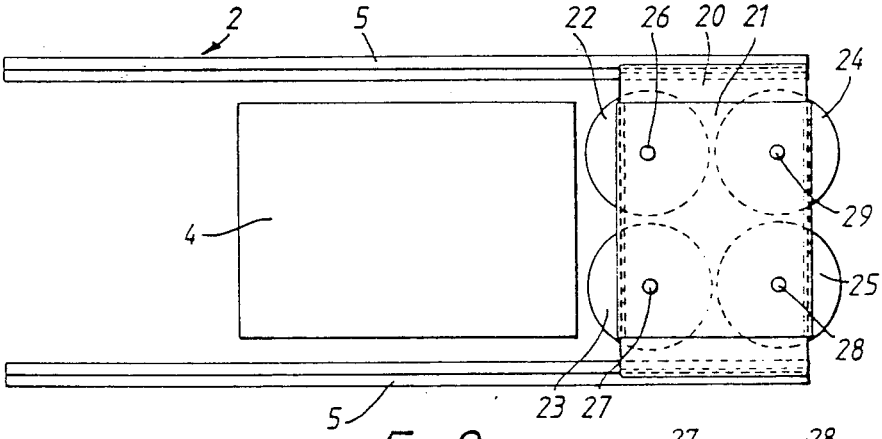
FIGS. 9 and 10 are plan and side views respectively of the smoothing station of the apparatus.
Figure 10:
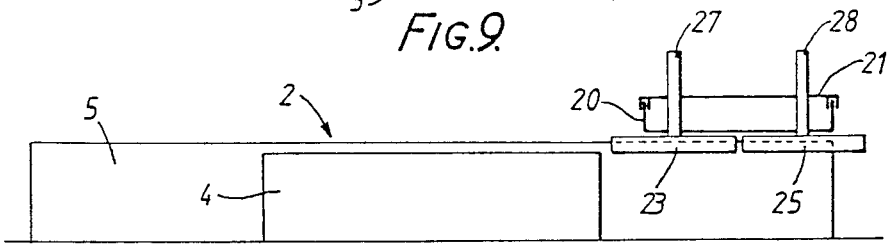

FIGS. 9 and 10 illustrate the smoothing station. This has a bed 4 flanked by rails 5, similar to the bed 4 and rails 5 of grinding station 1. A gantry 20, similar to gantry 11, is provided with a traversing trolley 21 which carries four smoothing wheels 22, 23, 24, and 25 mounted on axles 26, 27, 28 and 29 respectively. The polishing wheels 22, 23, 24, and 25 are cast iron pads. Arrangements (not shown) are provided for feeding a slurry of abrasive particles between the smoothing wheels 22, 23, 24 and 25 and the upper face of a glass sheet held on bed 4 by means of vacuum applied to its underface. Hydraulic rams (not shown) are provided to control the pressure exerted by the smoothing wheels 22, 23, 24 and 25 on the upper surface of the glass sheet. As illustrated in FIGS. 9 and 10 the trolley 20 has just completed a pass from left to right (as illustrated in FIGS. 9 and 10) so as to complete a smoothing operation.

Figure 11:
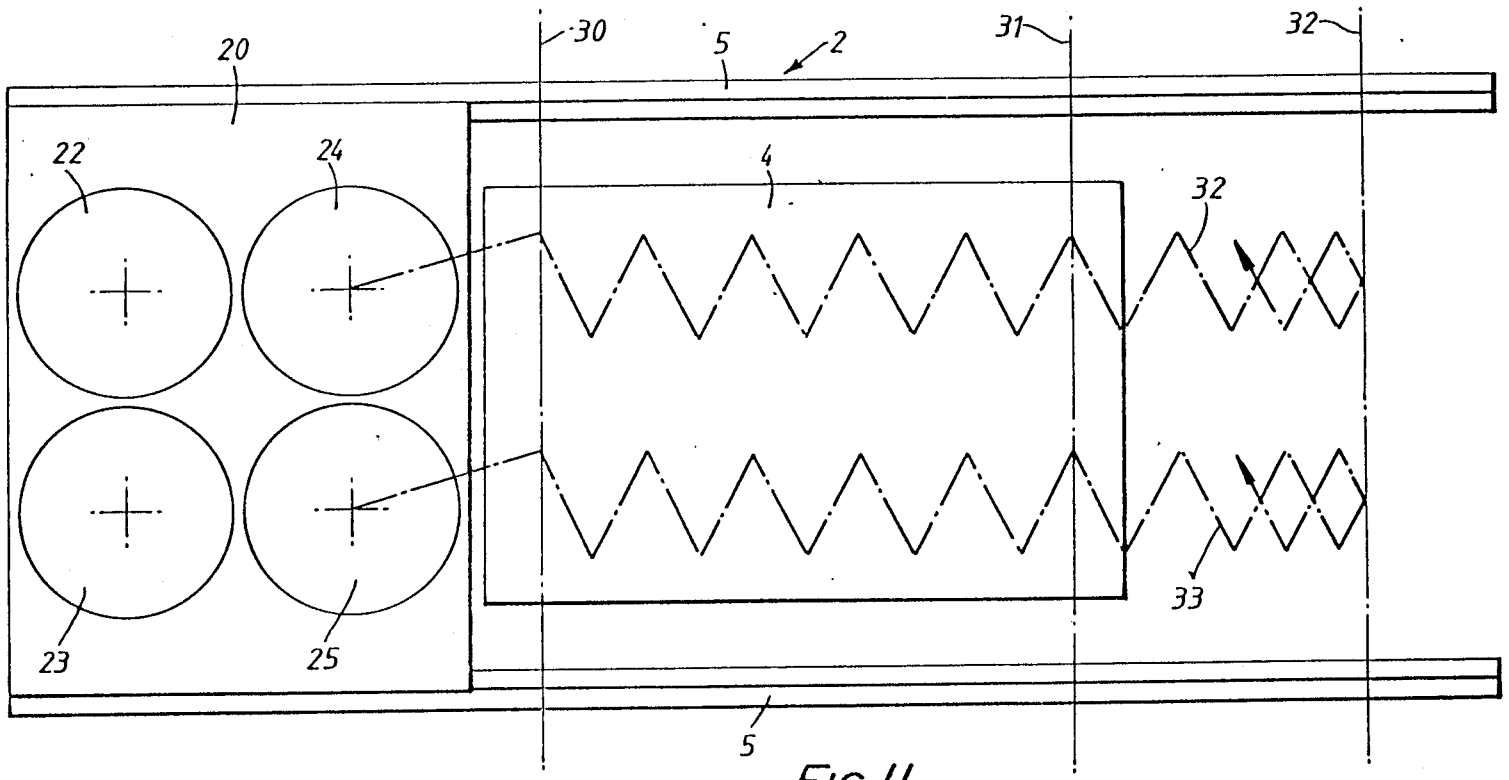
FIG. 11 is a further plan view of the smoothing station showing the loci of the axes of the smoothing wheels during the smoothing operation.

FIG. 11 illustrates the operation of a slightly modified form of smoothing station compared with that of FIGS. 9 and 10, the trolley 20 having different dimensions.

In the position illustrated in FIG. 11, the wheels 22, 23 24 and 25 are in their raised position. The trolley is then moved in a left to right direction (as illustrated in FIG. 11) until the axes of wheels 24, 25 reach the position indicated by the dotted lien 30. At the same time the traversing movement of trolley 21 (not shown in FIG. 11) is commenced. Upon the axes of wheels 24, 25 reaching line 30, all four wheels 22, 23, 24 and 25 are lowered until they contact the upper surface of the glass sheet to be smoothed, which is held on bed 4 by the vacuum applied on its underface, the abrasive suspension is fed to the wheels at the appropriate rate, and rotation of the wheels is commenced. Then a preset pressure is applied to the smoothing wheels 22, 23, 24 and 25 by means of hydraulic rams (not shown) provided for the purpose. The rightward movement of the gantry 20 is then continued, whilst the traversing movement of the trolley 21 continues simultaneously. Upon the axes of the wheels 22, 23 reaching the position indicated by the dotted line 31, the wheels are raised from the glass. When the axes of the wheels 24, 25, reach the position indicated by the dotted line 32, the direction of movement of the gantry 20 is reversed so that it commences to move leftwards (as shown in FIG. 11). When the axes of the wheels 22, 23 reach the position indicated by the dotted line at 31, the wheels are again lowered on to the glass, pressure is reapplied by the respective hydraulic rams and further smoothing takes place. Upon the axes of wheels 24, 25 reaching the position indicated by the dotted line 30, the wheels are again raised.

The loci of the axes of the wheels 24, 25 are shown in FIG. 11 as the zig-zag lines 32, 33 respectively. It will be noted that the pattern of movement of the wheels is different for the rightward movement from the corresponding pattern during the leftward movement of the gantry 20.

During the smoothing operation the peripheral speed of the smoothing wheels is generally in the range of from about 3 m/sec to about 10 m/sec.

Figure 12:
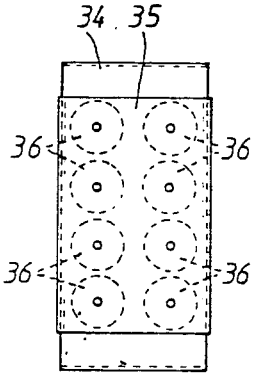
FIG. 12 is a plan view of the travelling gantry of the buffing station.
Figure 5:
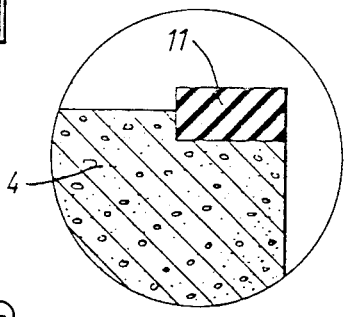
FIG. 5 is a detail on an enlarged scale of part of the bed of FIGS. 3 and 4.

FIG. 12 illustrates the corresponding gantry 34 for the buffing station 3. Gantry 34 carries a trolley 35 which can be traversed (in a vertical direction, as illustrated in FIG. 12) on gantry 34, as gantry 34 moves along the rails 5. Trolley 35 carries a number of buffing wheels in the form of felt pads. These buffing wheels are indicated at 36.

During the buffing operation a suspension of cerium oxide in water is fed by a suitable arrangement (not shown) between the revolving felt pads 36 and the upper surface of a sheet of glass which is held on bed 4 by means of partial vacuum applied to its under surface.

Figure 13:
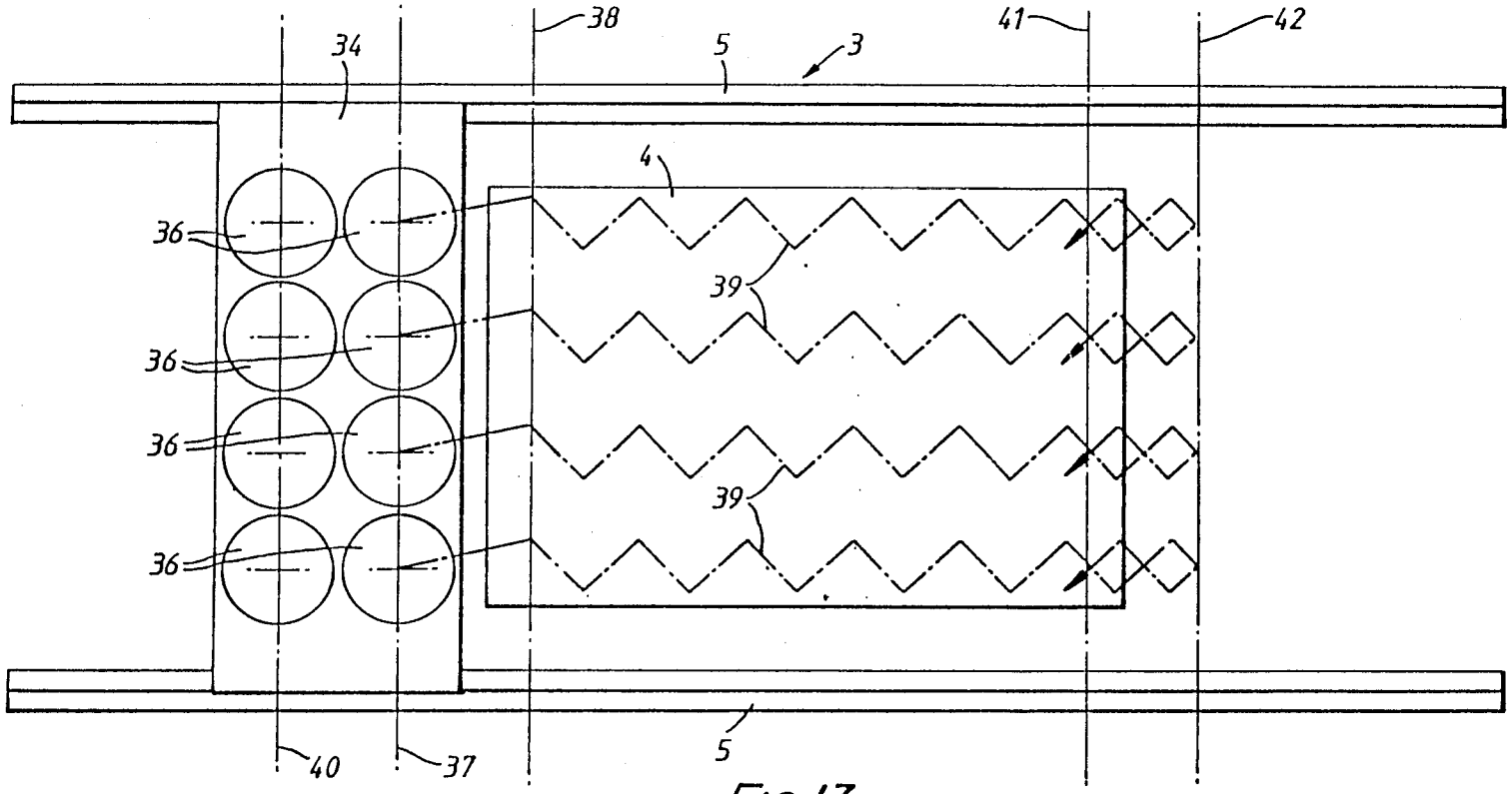
FIG. 13 is a plan view of the polishing station of the apparatus showing the loci of movement of the axes of the buffing wheels during the buffing operation.

The operation of buffing station 3 is similar to the operation of grinding station 2. Whilst traversing trolley 35 on gantry 34, gantry 34 is moved steadily from left to right, as illustrated in FIG. 13, along rails 5. Upon the axes of the forward row of buffing pads 36, indicated by dotted line 37, reaching the position indicated by dotted line 38, the pads 36 are lowered into contact with the glass sheet. The gantry 34 continues to move from left to right whilst the trolley 35 reciprocates backwards and forwards so that the axes of the buffing pads follow the paths indicated at 39. Upon the axes of the rearward buffing wheels, indicated by the dotted line 40, reaching the position indicated by dotted line 41, the pads are raised from the glass. When the axes of the forward polishing pads (indicated by dotted line 37) reaches the position indicated by dotted line 42, the direction of movement of the gantry 34 is reversed.

During the leftward traverse of the gantry 34, the buffing pads 36 are lowered into contact with the surface of the glass sheet when the axes of the now forward buffing wheels (indicated by dotted line 40) reaches the position indicated by dotted line 41. The reciprocation of trolley 35 upon gantry 34 continues during the leftward movement of gantry 34 upon rails 5 until the axes of the now rearward buffing pads (indicated by dotted line 37) reaches the position indicated by dotted line 38, at which time the buffing pads 36 are raised from the surface of the glass sheet.

As can be seen from FIG. 13 the locus of the buffing pads follows a different path during the leftward passage of the trolley 34 from the path they have followed during the rightward passage thereof.

During the buffing operation the peripheral speed of the buffing pads is generally in the range of from about 10 m/sec to about 20 m/sec.

To transfer glass from one station to the next, any convenient means may be used. For example, an overhead crane with, in place of a conventional hook, a frame with a number of suckers connected to a vacuum pump can be used to lift each sheet of glass from one bed 4 to the next between operation. The same vacuum pump can be used, for example, for the sucker pads on the support frame on the crane, the vacuum to the underside of the glass sheet being released before any attempt is made to pick it up. To ensure that the glass sheet is properly released from bed 4, air under slight pressure can be blown in via connection 10.

Provision may also be made for rinsing the surface of the glass sheet between adjacent stations so as to remove particulate material (e.g. glass dust and/or abrasive particles) before the next stage in the operation.

It has been stated above that the upper surface of bed 4 is flat. The necessary flatness can be achieved by using grinding wheels 13, 14 and 15 to grind the top surface of bed 4 after the concrete has been poured and set and rails 5 have been set up. In this way any inaccuracies in laying rails 5 do not affect significantly the operation of the apparatus.

We claim:

1. A method of polishing a glass sheet which includes the steps of grinding at least one major face thereof which comprise:

supporting the glass sheet on a fixed bed in a substantially horizontal position with an exposed surface uppermost;

providing a substantially horizontal gantry supported above said fixed bed so that said gantry can be traversed across the exposed upper surface of the glass sheet;

providing a plurality of diamond edged grinding wheels supported in the gantry each grinding wheel having a grinding face and each arranged for rotation about an axis which is substantially parallel to that of each other grinding wheel, each grinding face having a locus arranged to lie substantially in a common plane with the corresponding locus of the grinding face of each other grinding wheel;

setting said grinding wheels at respective heights above the fixed bed such that said common plane lies marginally below the exposed upper surface of the glass sheet and such that the locus of the grinding face of each grinding wheel is at a different height above the fixed bed from that of each other grinding wheel, in dependence upon the height of peaks and valleys in the exposed upper surface of the glass sheet; and moving the gantry relative to the fixed bed onto the glass sheet so as to cause the grinding wheels to traverse the glass sheet and to cause each grinding wheel to remove a respective stratum of glass from the glass sheet in passage thereover.

2. A method according to claim 1, in which the glass sheet is held on the bed by applying a partial vacuum to the undersurface of the sheet.

3. A method according to claim 1, in which the grinding wheels are carried on a gantry which spans the bed and which is arranged to run on rails extending along opposite sides of the bed.

4. A method according to claim 3, in which the grinding wheels are carried on a sub-carrier which is arranged to move relative to the gantry in a direction transverse to the rails.

5. A method according to claim 4, in which the sub-carrier is a trolley.

6. A method according to claim 1, in which the height of the grinding face of the lowermost grinding wheel above the bed is set so as to remove a stratum of glass lying below the bottom of the deepest valley present in the exposed upper surface of the glass sheet.

7. A method according to claim 1, in which the grinding faces of the grinding wheels are set at respective heights such that each grinding wheel removes a stratum of glass of substantially equal depth.

8. A method according to claim 1, in which the upper surface of the bed is prepared by traversing the grinding wheels across the exposed surface thereof.

9. A method according to claim 1 which includes the subsequent step of smoothing the surface of the glass sheet with at least one cast iron smoothing wheel in conjunction with a suspension of abrasive particles.

10. A method according to claim 9 which includes the subsequent step of buffing the smoothed surface of the glass sheet with rotating felt pads in conjunction with a suspension of abrasive particles.

11. A method according to claim 1, in which the grinding wheels are rotated at a rate such as to impart a rim speed thereto to from about 22 m/sec to about 27 m/sec.

12. Apparatus for polishing a glass sheet which includes a grinding station comprising:

a fixed bed for supporting a glass sheet in a substantially horizontal position with an exposed surface uppermost;

a substantially horizontal gantry supported above the fixed bed so that said gantry can be traversed across the exposed upper face of the glass sheet;

a plurality of diamond edged grinding wheels supported on said gantry, each grinding wheel having a grinding surface and each arranged for rotation about an axis which is substantially parallel to the axis of rotation of each other grinding wheel, each grinding face having a locus arranged to lie substantially in a common plane with the corresponding locus of each other grinding wheel, said grinding wheels further being arranged so that each grinding wheel can be set at a respective height above said fixed bed such that said common plane lies marginally below the exposed upper surface of the glass sheet and such that the locus of the grinding face of each grinding wheel is at a different height above the fixed bed from that of each other grinding wheel, in dependence upon the height of peaks and valleys in the exposed upper surface of the glass sheet; and means for moving the gantry relative to the fixed bed over the glass sheet so as to cause the grinding wheels to traverse the glass sheet and to cause each grinding wheel to remove a respective stratum of glass from the glass sheet in passage thereover.

13. Apparatus according to claim 12, in which the bed comprises means for applying a partial vacuum to the undersurface of said sheet.

14. Apparatus according to claim 13, in which the bed is provided with a peripheral gasket to assist in sealing.

15. Apparatus according to claim 13, in which the gantry spans the bed and is arranged to run on rails extending along opposite sides of the bed.

16. Apparatus according to claim 15, in which the grinding wheels are carried on a sub-carrier which is arranged to move relative to the gantry in a direction transverse to the rails.

17. Apparatus according to claim 16, in which the sub-carrier is a trolley.

18. Apparatus according to claim 12, in which the bed comprises a block of concrete having an upper surface which has been prepared by traversing the grinding wheel thereover.

19. Apparatus according to claim 12 which further includes a smoothing station comprising means for smoothing the ground surface of the glass sheet with revolving cast iron wheels in conjunction with an abrasive suspension.

20. Apparatus according to claim 19 which further includes a buffing station comprising means for buffing the smoothed surface of the glass sheet with revolving buffing pads in conjunction with an abrasive suspension.

21. Apparatus according to claim 12, in which the grinding wheels are arranged for rotation at a rate such as to impart a rim speed thereto of from about 22 m/sec to about 27 m/sec.

* * * * *